US006694771B2

(12) United States Patent
Kim et al.

(10) Patent No.: US 6,694,771 B2
(45) Date of Patent: Feb. 24, 2004

(54) CAN RECEIVING APPARATUS FOR REFRIGERATOR

(75) Inventors: Hyun Gyo Kim, Pusan-shi (KR); Young Chul Seon, Kyongsangnam-do (KR); Dae Yeon Kim, Pusan-shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/216,565

(22) Filed: Aug. 12, 2002

(65) Prior Publication Data

US 2003/0046951 A1 Mar. 13, 2003

(30) Foreign Application Priority Data

| | | |
|---|---|---|
| Sep. 7, 2001 | (KR) | P 2001-55224 |
| Sep. 11, 2001 | (KR) | P 2001-55966 |
| Sep. 14, 2001 | (KR) | P 2001-56888 |
| Sep. 14, 2001 | (KR) | P 2001-56889 |
| Sep. 14, 2001 | (KR) | P 2001-56907 |

(51) Int. Cl.[7] ..... F25D 25/00
(52) U.S. Cl. ..... 62/465; 62/440
(58) Field of Search ..... 62/465, 466, 440

(56) References Cited

FOREIGN PATENT DOCUMENTS

| | | | |
|---|---|---|---|
| JP | 403110376 A | * | 5/1991 |
| JP | 407021454 A | * | 1/1995 |

* cited by examiner

*Primary Examiner*—Melvin Jones
(74) *Attorney, Agent, or Firm*—McKenna Long & Aldridge LLP

(57) ABSTRACT

A can receiving apparatus for a refrigerator. The can receiving apparatus includes an inner case, possibly having a plurality of speed reducing ribs, of a door having ribs. A support member is retained by the door ribs, beneficially using U-shaped fastening members. The support member can include rotation inducing elements that cause the support member to interact with an interior wall to reduce the speed of a can falling through a can receiving space. A stop member prevents cans from falling out of the can receiving space. The stop member can be relieved to reduce the difficulty of removing a can from the can receiving space.

41 Claims, 15 Drawing Sheets

CAN RECEIVING APPARATUS FOR REFRIGERATOR

This application claims the benefit of the Korean Application Nos. P2001-55224, filed on Sep. 7, 2001; P2001-55966, filed on Sep. 11, 2001; P2001-56888, filed on Sep. 14, 2001; P2001-56889, filed on Sep. 14, 2001; and P2001-56907, filed on Sep. 14, 2001, all of which are hereby incorporated by reference.

BACKGROUND OF THE INVENTION

1. Field of the Invention

The present invention relates to refrigerators. More particularly, the present invention relates to refrigerators having can receiving devices.

2. Discussion of the Related Art

Generally, a refrigerator includes a freezing compartment and a refrigerating compartment that are maintained at constant, low temperatures. To accomplish this, a refrigerator operates along a refrigerating cycle by the action of a compressor, a condenser, capillaries, and an evaporator. A refrigerant at low temperature and low pressure passes through refrigerant pipes. The refrigerant evaporates, removing heat, and thus cooling, the air surrounding the evaporator. The cooled air is supplied to the freezing compartment and to the refrigerating compartment to cool them.

Most refrigerators have front doors that enable opening and closing of the freezing compartment and/or the refrigerating room. Often, such doors have interior can-receiving devices for storing cans. The structure and operation of a typical door having a can-receiving device is explained with reference to FIG. 1. As shown, a refrigerator door 1 includes an outer case 2 and an inner case 3 that is fastened to the outer case 2. While not shown, between the outer case 2 and the inner case 3 is an insulation material, typically polyurethane.

Still referring to FIG. 1, the inner case 3 has a plurality of projecting ribs 4*a*, 4*b*, and 4*c* that define predetermined spaces between those ribs. The rib 4*c* is at the center of the inner case 3, the rib 4*a* is on the left, and the rib 4*b* is on the right. Beneficially, the ribs 4*a*, 4*b*, and 4*c* are integral parts of the inner case 3.

A can-receiving space 10 is formed by a support member 6 that is installed between ribs 4*a* and 4*c*. Additionally, a stop member 7 is installed below the support member 6.

The support member-6 includes a longitudinally extending bar 6*a* that is fixed in position by upper and lower transverse bars 6*b* and 6*c*, and which extends between rib 4*a* and rib 4*c*. The bar 6*a* is for guiding and retaining cans in the can-receiving space 10. The stop member 7 is a bar that extends between rib 4*a* and rib 4*c* that stops cans from dropping through the can receiving space 10. The ribs 4*a* and 4*c* have fastening holes 5*a*, 5*b*, and 5*c* for retaining the support member 6 and the stop member 7.

Referring now to FIG. 2, a side cut-away view of FIG. 1, the longitudinal bar 6*a* and the interior wall of the inner case 3 form a can inlet 8 and a can outlet 9. The can outlet 9 is partially blocked by the stop member 7. Accordingly, a can 11 put through the inlet 8 drops freely through the can receiving space 10 until it is stopped by the stop member 7. When desired, a user can remove the can 11 from the outlet 9.

While generally successful, the can-receiving assembly described above has problems. First, to install the support member 6 and the stop member 7, a plurality of fastening holes 5*a* to 5*c* are formed on ribs 4*a* and 4*c*. Since the fastening holes pass through a wall of the inner case 3, the insulation material between the inner case 3 and the outer case 2 can come out of the fastening holes.

Second, to insert the support member 6 and the stop member 7 into the fastening holes 5*a* to 5*c*, a space wider than the support member 6 and the stop member 7 should be temporarily formed between the ribs 4*a* and 4*c*. To do so, the space between the ribs 4*a* and 4*c* should be expanded by flexing the ribs 4*a* and 4*c*. However, because those ribs are hard, this can be difficult to do.

Third, a can 11 dropped into the can-receiving assembly can strike the stop member 7 and the inner case 3 with great impact. Thus, the inner case 3 may be damaged and significant noise can be generated.

Fourth, it is relatively difficult for a user to remove a can 11 due to the structure of the stop member 7. As shown in FIG. 3, to remove a can 11, the user should hold the can 11 in one hand while lifting all of the other cans with the other hand. In other words, a user should use both hands to remove a can 11. This is inconvenient. Also, a user must push their hand into a narrow space below the stop member 7. This is also inconvenient.

FIG. 4 illustrates another type of can-receiving apparatus. That apparatus is designed to attach with a shelf in the refrigerator. As shown, the can-receiving apparatus takes the form of a receptacle 20 having a rear can inlet 21 and a front can outlet 22. Hooks 24 are used to fixing the receptacle 20 to the shelf. The hooks 24, which are located -on the front and rear of the receptacle 20, include hook grooves 24*a* for grabbing a shelf. The front of the receptacle 20 includes a support guide 23 for preventing cans from freely dropping out of the can outlet 22.

The receptacle 20 beneficially hangs down from the shelf at an incline such that a can placed in the inlet 21 rolls down to the outlet 22 where it is stopped by the support guide 23.

While generally successful, the can-receiving apparatus of FIG. 4 has a significant problem in that it does not easily accommodate cans of different sizes. This is primarily because the receptacle 20 has a constant width W. Thus, if the length of the can is longer than the width of the receptacle 20, the corresponding can cannot be received in the receptacle. Additionally, if a can is shorter than the width W, the can is liable to turn in the receptacle and jam its operation.

Therefore, a new can-receiving apparatus would be beneficial.

SUMMARY OF THE INVENTION

Accordingly, the present invention is directed to a can-receiving apparatus for a refrigerator that substantially obviates one or more problems due to limitations and disadvantages of the related art.

An object of the present invention is to provide a can-receiving apparatus for a refrigerator that avoids leakage of door insulation material and that enables easy installation.

Another object of the present invention is to provide a can-receiving apparatus for a refrigerator that can minimize door damage and noise caused by dropping cans.

A further object of the present invention is to provide a can-receiving apparatus for a refrigerator that enables easy can removal.

A still further object of the present invention is to provide a can-receiving apparatus for a refrigerator that can accommodate cans of diverse sizes.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a can-receiving assembly for a refrigerator includes an inner case having spaced apart ribs that project from an inner wall of the inner case, a support member installed between the ribs and spaced apart from the inner wall such that a can-receiving space is formed, a stop member installed between the ribs and below the support member for stopping cans from dropping through the can-receiving space, and a fastening member installed on the ribs and dimension to receive the support member and the stop member such that those members are indirectly fastened to the ribs.

In another aspect of the present invention, a can-receiving apparatus for a refrigerator includes an inner case having spaced apart ribs that project from an inner wall of the inner case, a support member installed between the ribs and spaced apart from the inner wall such that a can-receiving space is formed, a stop member installed between the ribs and below the support member for stopping cans from dropping through the can-receiving space, and a speed reduction element for reducing the speed of a can dropping through the can-receiving space.

In still another aspect of the present invention, a can-receiving apparatus for a refrigerator includes an inner case having spaced apart ribs that project from an inner wall of the inner case, a support member installed between the ribs and spaced apart from the inner wall such that a can-receiving space is formed, a stop member installed between the ribs and below the support member for stopping cans from dropping through the can-receiving space, with the stop member having a relieved center portion for enabling easy can removal.

In still another aspect of the present invention, a can receiving apparatus for a refrigerator includes a receptacle, comprised of first and second main bodies that form a can receiving space when the first and second main bodies are mated together, an inlet formed near the back of the receptacle, an outlet formed at the front of the receptacle, a fixing structure for attaching the receptacle to a shelf, and a fastening structure for fastening of the first and the second main bodies together such that the width of the can-receiving space can be adjusted in accordance with a size of a can.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE ILLUSTRATED EMBODIMENTS

Reference will now be made in detail to illustrated embodiments of the present invention, examples of which are shown in the accompanying drawings. Wherever possible, the same reference numbers will be used throughout the drawings to refer to the same or like parts, and the additional explanation thereof will be omitted.

First Embodiment

Figure 1:
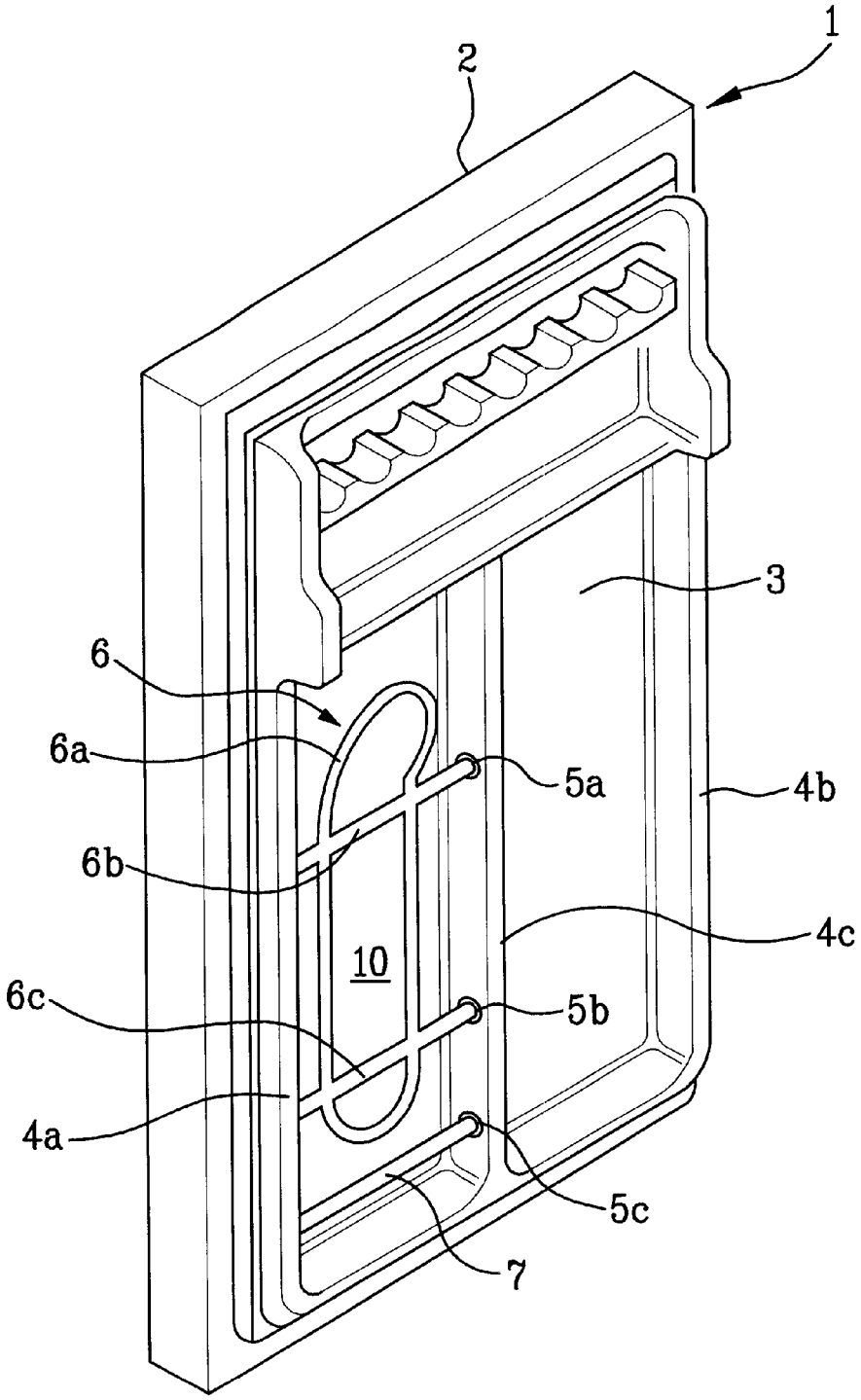
FIG.1 Prior Art
FIG. 1 is a perspective view illustrating a conventional can receiving apparatus for a refrigerator.
Figure 2:
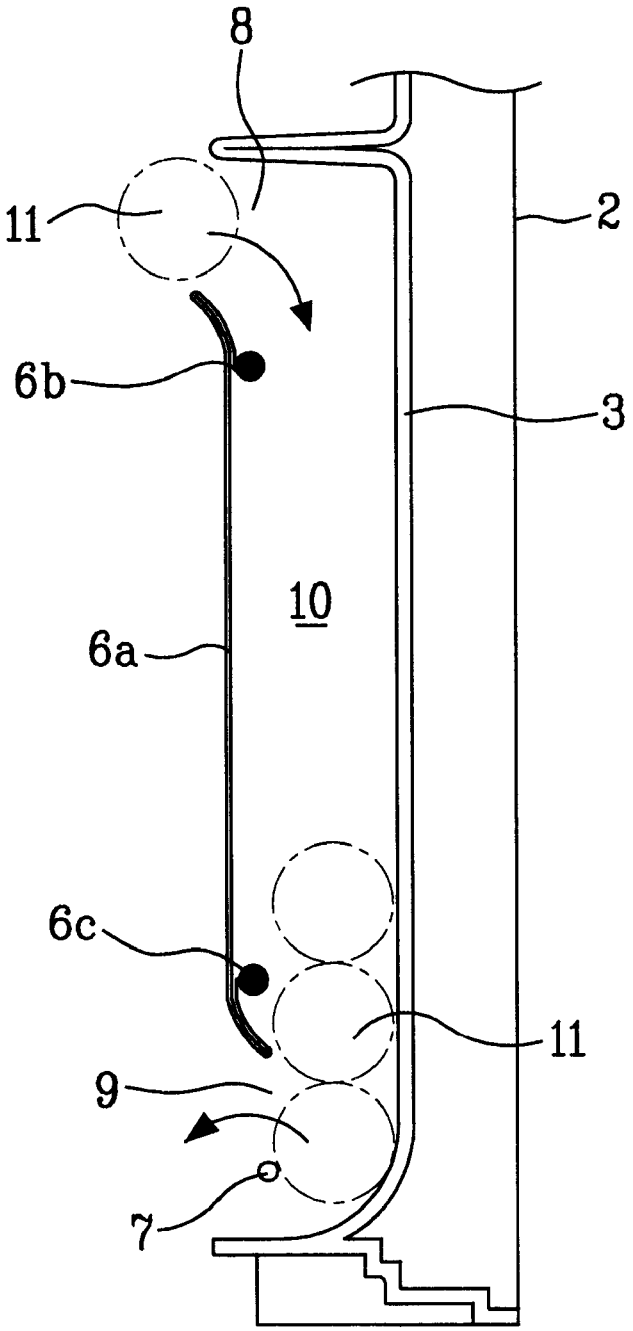
FIG. 2 Prior Art
FIG. 2 is a side sectional view of the can receiving apparatus of FIG. 1.
Figure 3:
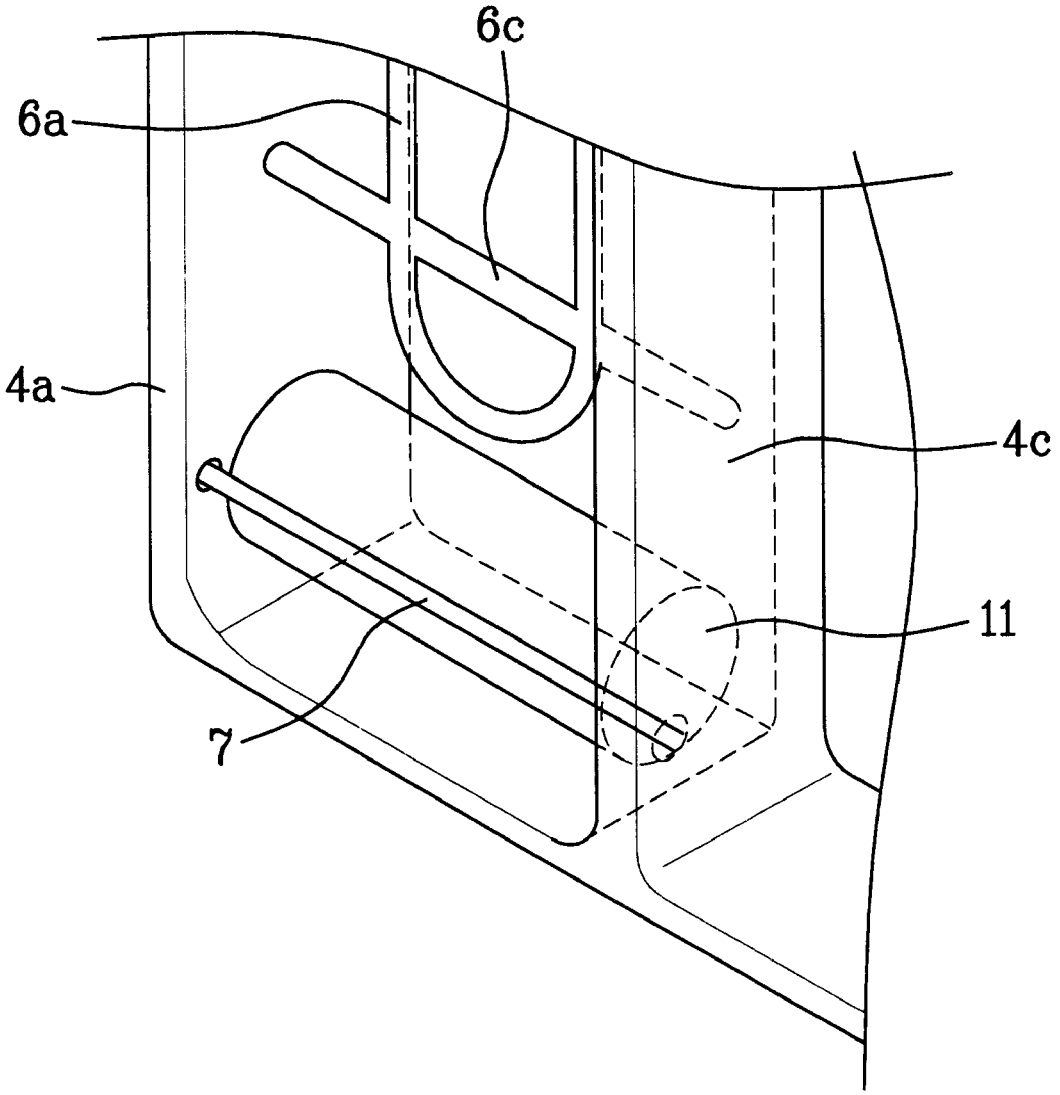
FIG. 3 Prior Art
FIG. 3 is an enlarged perspective view of the stopper in the can receiving apparatus of FIG. 1.
Figure 4:
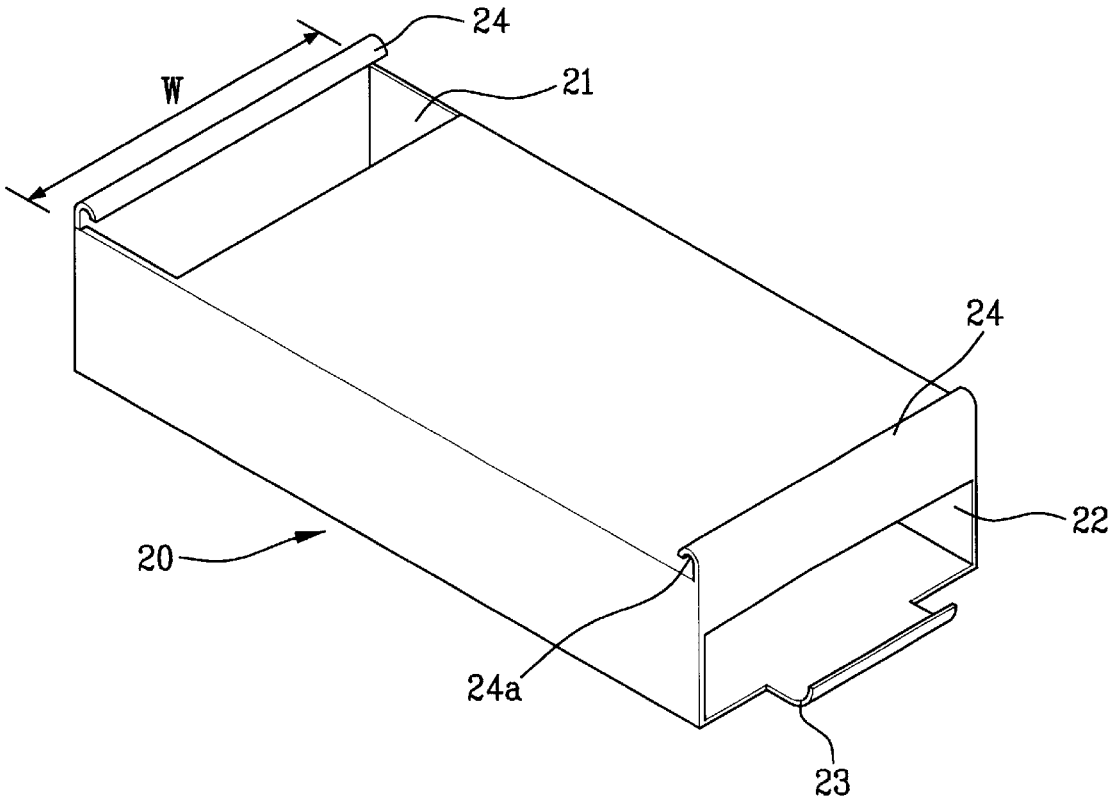
FIG. 4 Prior Art
FIG. 4 is a perspective view illustrating another type of conventional can receiving apparatus for a refrigerator.
Figure 5:
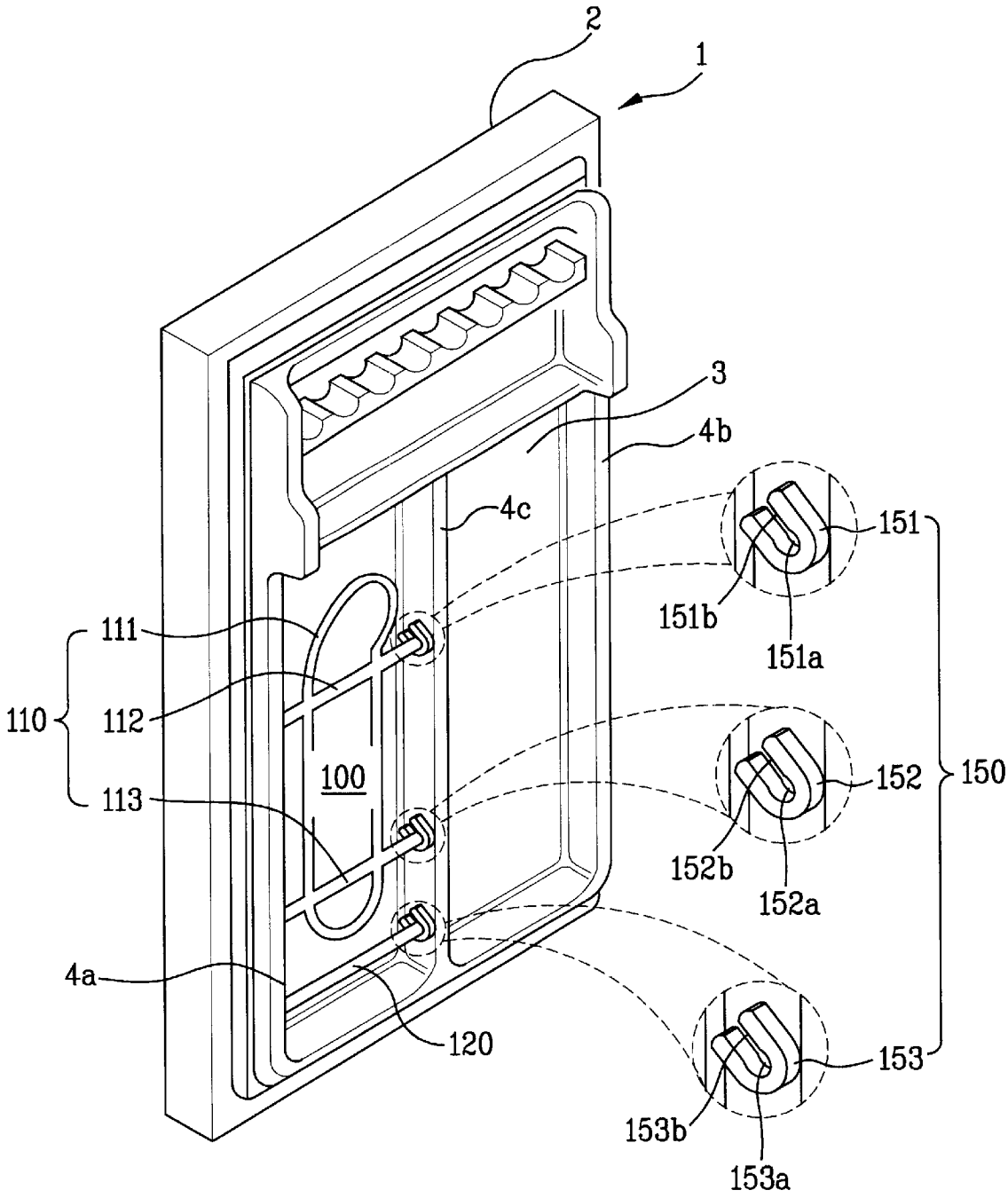
FIG. 5 is a perspective view illustrating a can-receiving apparatus for a refrigerator according to a first embodiment of the present invention.
Figure 6:
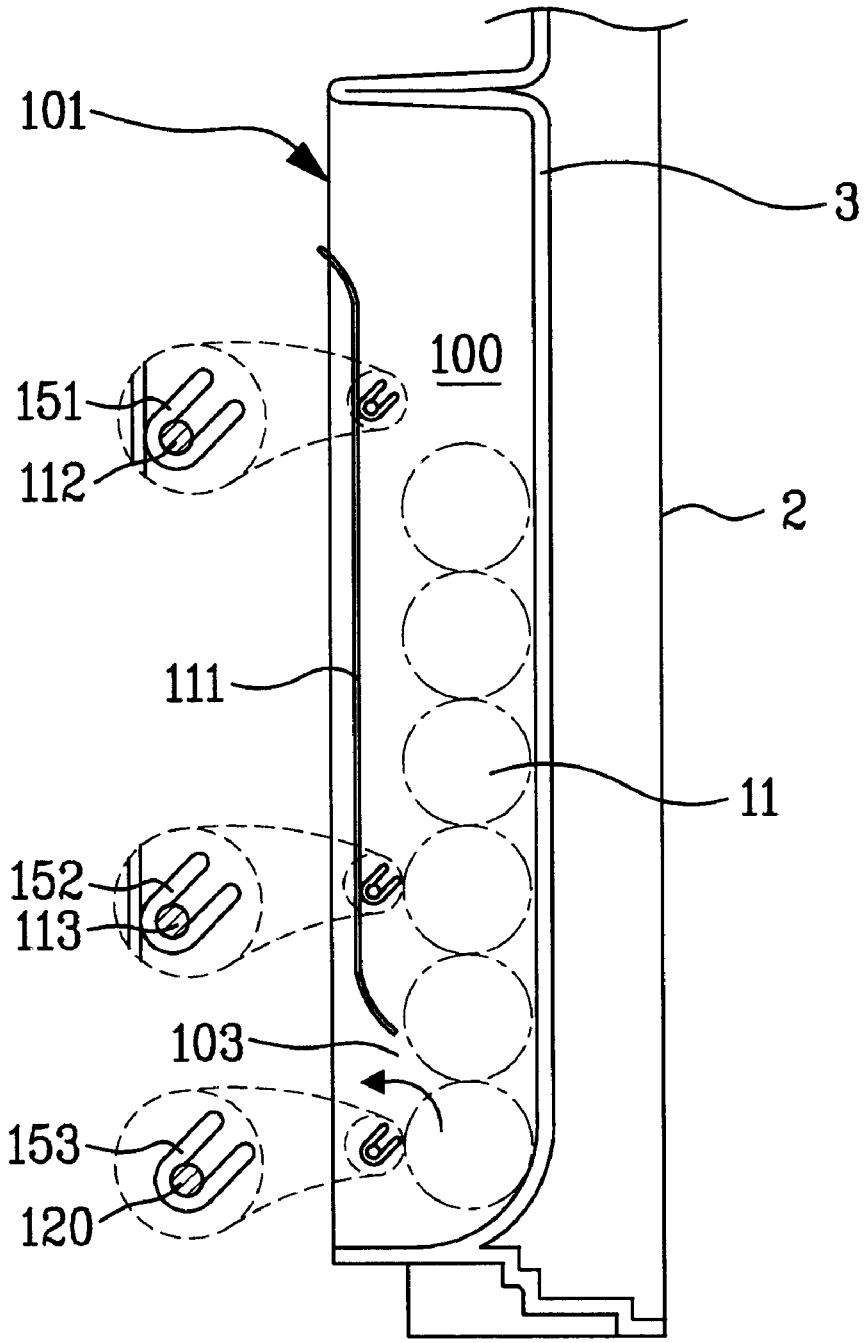
FIG. 6 is a side sectional view of the can receiving apparatus of FIG. 5.

FIG. 5 is a perspective view illustrating a can receiving apparatus for a refrigerator according to a first embodiment of the present invention. FIG. 6 is a side sectional view of the can receiving apparatus of FIG. 5. Referring now to FIG. 5, the first embodiment can receiving apparatus includes a refrigerator door 1 comprised of an outer case 2 and an inner case 3 that is fastened to the outer case 2. The inner case 3 forms an interior wall of the door 1. An insulation material (not illustrated) is beneficially disposed between the outer case 2 and the inner case 3. Ribs 4*a*, 4*b*, and 4*c* are formed on and protrude from the interior wall of a door 1. The rib 4*a* is on the left of the inner case 3, the rib 4*b* on the right side, and rib 4*c* is disposed between ribs 4*a* and 4*b*.

Still referring to FIG. 5, a support member 110 is installed on ribs 4*a* and 4*c* such that a can receiving space 100 is formed between the interior wall and the support member 110. A stop member 120 is installed below the support member 110.

The support member 110 comprises a longitudinal bar 111 and upper and lower transverse bars 112 and 113. The upper and lower transverse bars 112 and 113 extend between rib 4*a* and rib 4*c* and spatially fix the longitudinal bar 111 a predetermined distance from the interior wall formed by the inner case 3. This spatial arrangement forms the can receiving space 100. Cans in a horizontal state can be located in the can receiving space 100.

The stop member 120 is comprised of a bar having ends fixed to ribs 4*a* and 4*c*. The stop member 120 prevents cans from dropping through the can receiving space 100.

Still referring to FIG. 5, the support member 110 and the stop member 120 are indirectly fixed to ribs 4*a* and 4*c* by fastening elements 150 that are attached to those ribs. The fastening elements 150 comprise U-shaped fastening projections 151 to 153. Three U-shaped fastening projections 151 to 153 are installed on rib 4*c* (shown in FIG. 5) and three additional U-shaped fastening projections 151–153 are installed on rib 4*a* (shown in FIG. 6). For convenience, the top U-shaped fastening projections are referred to as first fastening projections 151, the bottom U-shaped fastening projections are referred to as third fastening projection 153, and the interposed U-shaped fastening projections are referred to as second fastening projections 152. The upper transverse bar 112 extends between the first fastening projections 151, the lower transverse bar 113 of the support rib extends between the second fastening projections 152, and the stop member 120 extends between the third fastening projections 153.

The "U"-shaped fastening projections 151 to 153 have fastening grooves 151*a*, 152*a*, and 153*a* for receiving ends of the upper and lower transverse bars 112 and 113 the ends of the stop member 120. Open portions 151*b*, 152*b*, and 153*b* are used to receive the ends of the upper and lower transverse bars 112 and 113 and the ends of the stop member 120. It is beneficial that the open portions 151*b* to 153*b* are inclined at a predetermined angle so that they lead toward the interior wall formed by the inner case 3. This simplifies installation of the support member 110 and of the stop member 120. When the support member 110 and the stop member 120 are pulled obliquely downward into the open portions 151*b* to 153*b*, the support member 110 and the stop member 120 can be completely fit into the fastening grooves 151*a* to 153*a*.

The fastening elements 150 may be integrally formed with the inner case 3, or they may be selectively attached to the ribs 4*a* and 4*c*.

FIG. 6 shows a side cut-away view of the support member 110 and the stop member 120 fastened to the inner case 3 of the door 2. As shown, the can receiving space 100 is formed between the longitudinal bar 111 and the interior wall formed by the inner case 3. The support member 110 is fixed to the ribs by inserting the upper and lower transverse bars into the fastening U-shaped grooves of the first and second U-shaped fastening projections 151 and 152. Also, the stop member 120 is firmly fixed to the rib of the inner case 3 since both of its ends are inserted into the fastening U-shaped grooves of the third U-shaped fastening projection 153.

An inlet 101 is formed between an upper end of the longitudinal bar 110 and the interior wall of the inner case 3. An outlet 103 is formed between a lower end of the longitudinal bar 110 and the stop member 120. Accordingly, a can 11 put into the inlet 8 drops through the can receiving space 100 until it is stopped by the stop member 120 (or until stopped by another can 11). A can 11 can be removed from the outlet 103.

In summary, according to the first embodiment of the present invention, fastening holes in the ribs 4*a* and 4*c* are not required since the support member 110 and the stop member 120 are fastened to the ribs 4*a* and 4*c* by the U-shaped fastening projections 150. Thus, insulation material leakage is prevented. In addition, since the support member 110 and the stop member 120 are shorter than the space between the ribs 4*a* and 4*c*, flexing of the ribs 4*a* and 4*c* is not required and installation problems are reduced.

Second Embodiment

Figure 7:
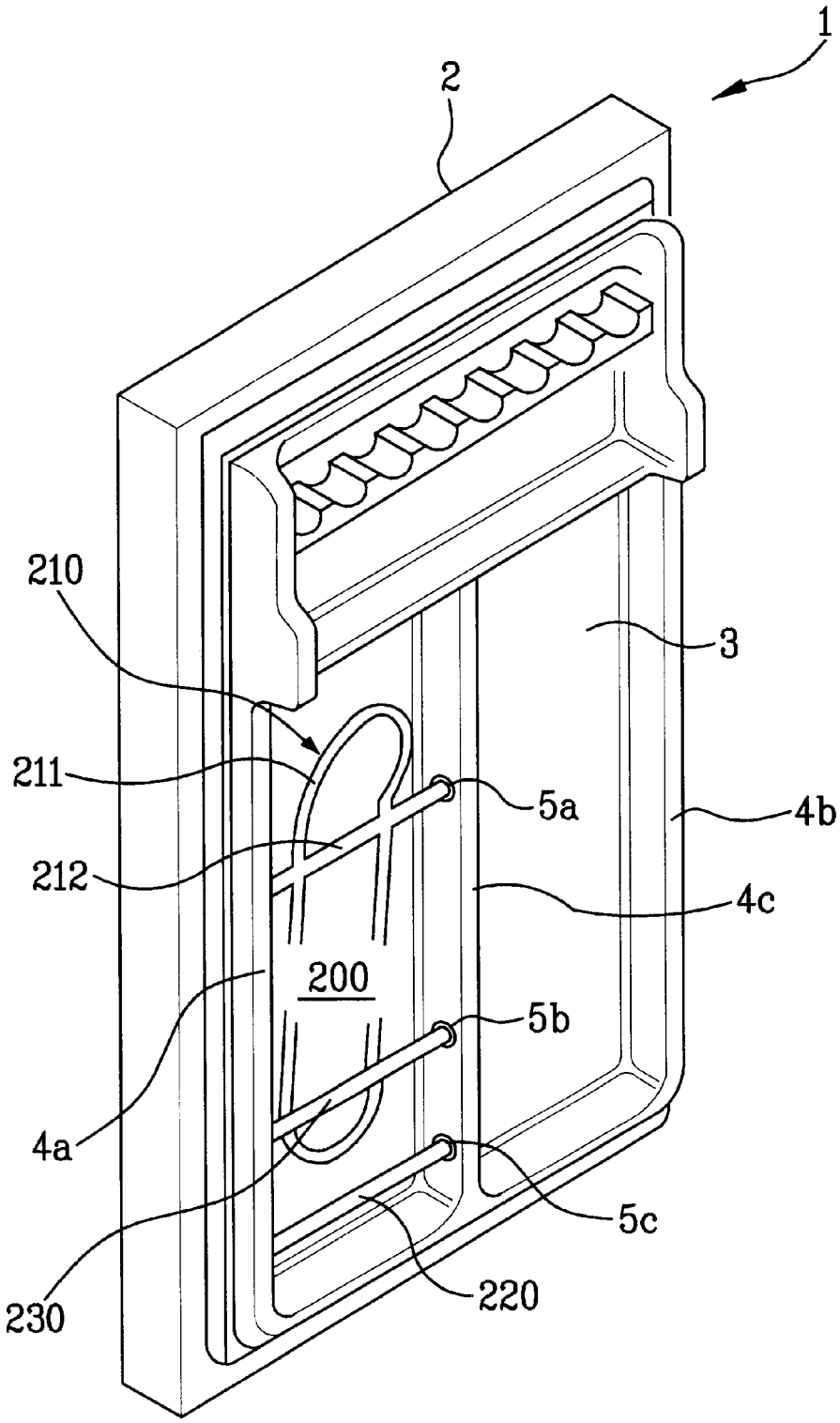
FIG. 7 is a perspective view illustrating a can receiving apparatus for a refrigerator according to a second embodiment of the present invention.
Figure 8A:
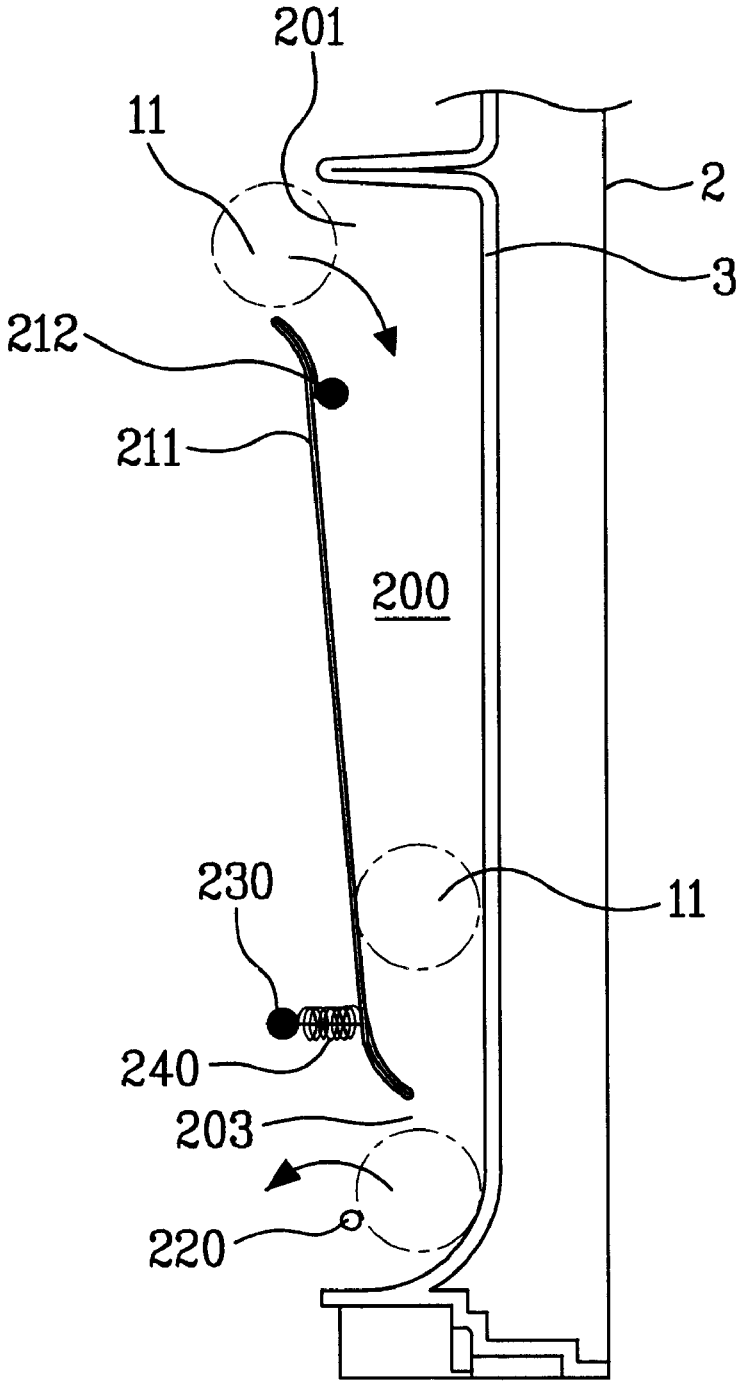
FIGS. 8A and 8B are side sectional views illustrating variations of the can receiving apparatus of FIG. 7.
Figure 8B:
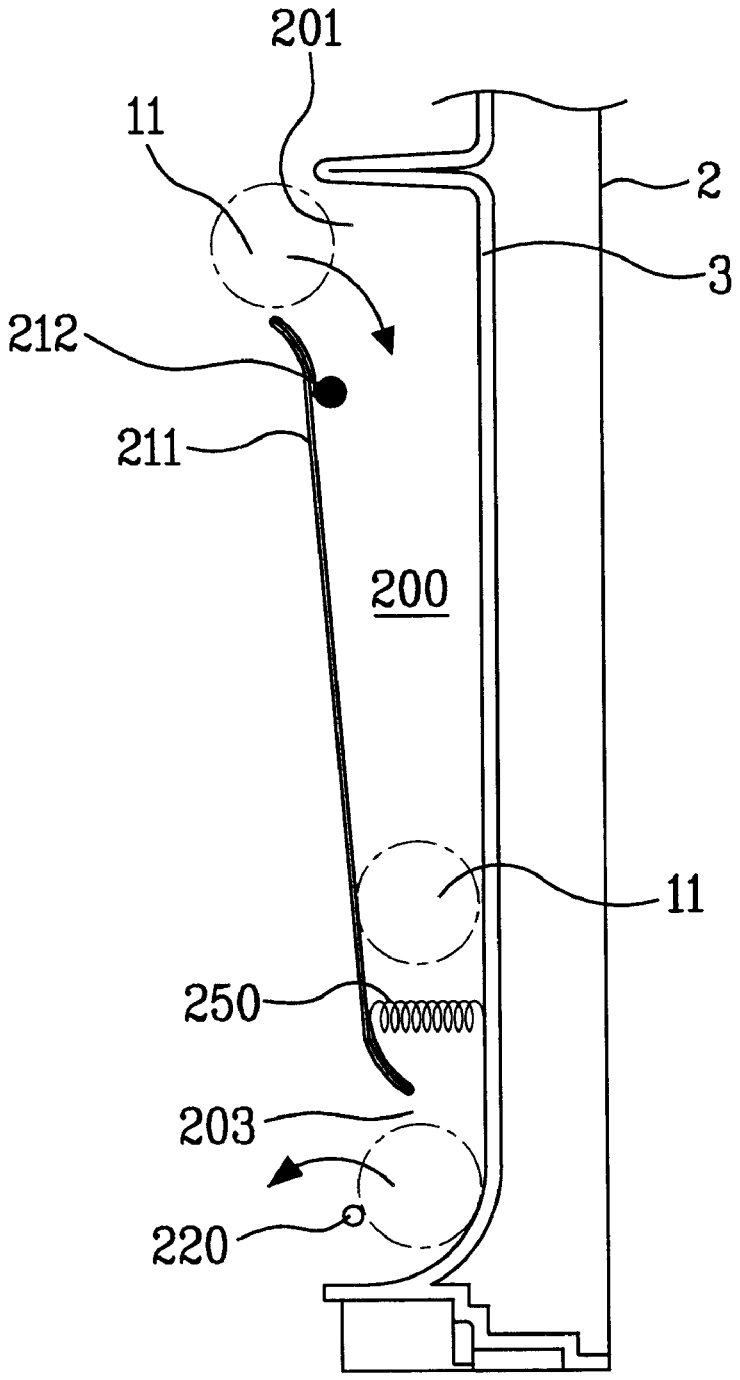

FIG. 7 is a perspective view illustrating a can receiving apparatus for a refrigerator according to a second embodiment of the present invention, while FIGS. 8A and 8B show sectional views of the can receiving apparatus of FIG. 7. Referring now to FIG. 7, the second embodiment of the present invention includes a door 1 that has the same general structure as the door shown in FIG. 5. Thus, the door 1 includes an outer case 2, and a plurality of projecting ribs 4*a*, 4*b*, and 4*c* on an inner case 3. A support member 210 for forming a can receiving space 200 is installed between ribs 4*a* and 4*c*. Additionally, a stop member 220 is installed below the support member 210. The second embodiment of the present invention includes speed-reducing features that reduce the speed of a can dropping through the can receiving space 200.

The support member 210 comprises a longitudinal bar 211 that is spaced apart by a rotary bar 212 from the interior wall formed by the inner case 3. The longitudinal bar 211 and the interior wall guide and retain cans within the can receiving space 200. The rotary bar 212 supports the longitudinal bar 211 and is attached to the ribs 4*a* and rib 4*c* such that the rotary bar 212 can rotate over a small angle. As is explained in more detail subsequently, the rotary bar 212 forms part of the speed reducing features. The stop member 220 is a bar member having ends fixed to the ribs 4*a* and rib 4*c*. The stop member forms a compulsorily stop for the cans in the can receiving space 200.

Still referring to FIG. 7, a plurality of fastening holes 5*a*, 5*b*, and 5*c* are formed in the ribs 4*a* and rib 4*c*. Fastening holes 5*a* and 5*c* retain the rotary bar 212 and the stop bar 220 in position. Additionally, a fixing bar 230 is installed in the fastening holes 5*b*. The purpose of the fixing bar 230 is described below.

Referring now to FIG. 8A, a spring 240 is placed between a lower portion of the longitudinal bar 211 and the fixing bar 230. The spring 240 has a restoring force that pushes the end of the support member 210 toward the interior wall of the inner case 3. The distance between the fixing bar 230 and the interior wall is greater than the distance between the longitudinal bar 211 and the interior wall.

The longitudinal bar 211 is installed with an incline relative to the interior wall. In other words, the distance between the longitudinal bar 211 and the interior wall is less at the outlet 203 than at the inlet 201. Thus, the space of the can receiving space 200 is less at the bottom than at the top. This enables a reduction in the dropping speed of a can 11.

As shown in FIG. 8A, a can 11 put into the inlet 201 drops down the can receiving space 200. During this process, the can contacts the longitudinal bar 211 and the interior wall of the inner case 3. The dropping can 11 then pushes against the longitudinal bar 211, resulting in compression of the spring 240 and rotation of the rotary bar 212. The can 11 eventually passes through the support member 210 and reaches the stop member 220. The spring 240 then forces the support member 210 to return to its original position.

An alternative to the structure shown in FIG. 8A is shown in FIG. 8B. In FIG. 8B there is no fixing bar 230. However, a spring 250 is installed between a lower portion of the longitudinal bar 211 of the support member 210 and the interior wall of the inner case 3. The spring 250 has a restoring force that pulls the longitudinal bar 211 toward the inner case 3. Thus, the can receiving space 200 is narrower at the bottom than at the top. A can 11 dropped into the inlet falls through the can receiving space 200 with a reduced speed.

Beneficially, the tension of the spring 240 or 250 can be adjusted to achieve a desired operation. Furthermore, other structures can be used in place of the spring 240 or spring 250. For example, a torsion spring could be located on the rotary bar 212.

In summary, according to the second embodiment of the present invention, the dropping speed of a can is reduced by speed reducing features that include a spring. Accordingly, can impacts on the inner case 3 can be reduced, resulting in reduced damage and noise.

Third Embodiment

Figure 9:
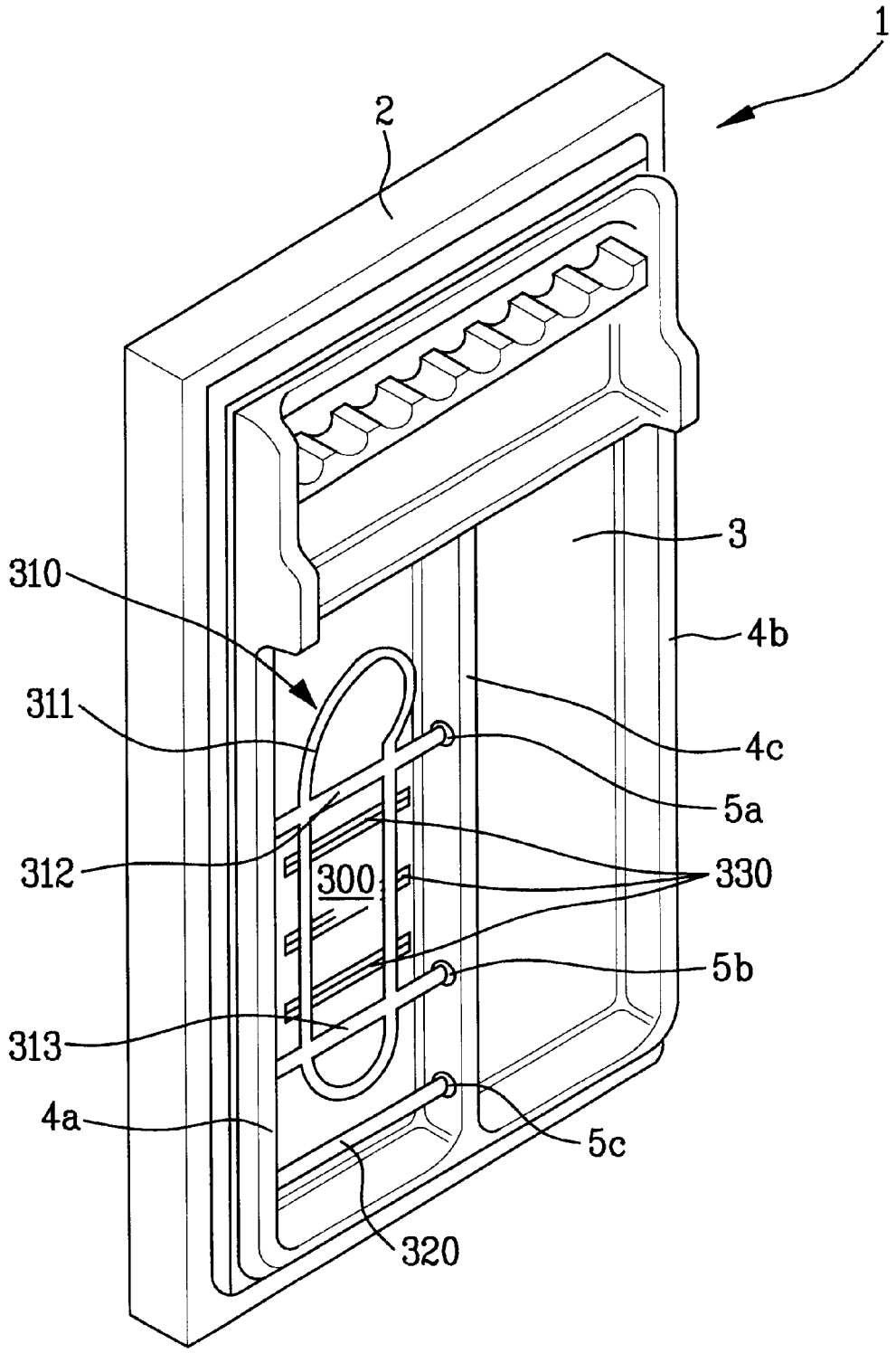
FIG. 9 is a perspective view illustrating a can receiving apparatus for a refrigerator according to a third embodiment of the present invention.
Figure 10:
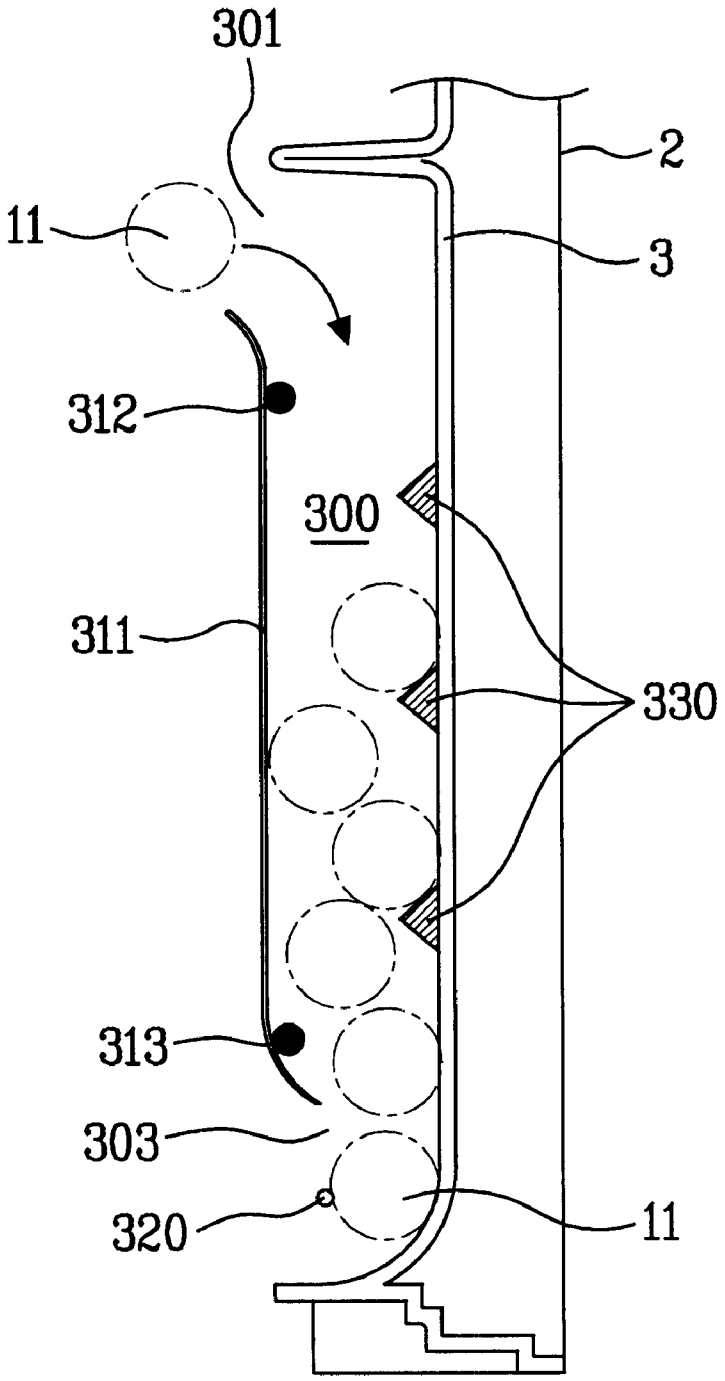
FIG. 10 is a side sectional view of the can receiving apparatus of FIG. 9.

FIG. 9 is a perspective view illustrating a can receiving apparatus for a refrigerator according to a third embodiment of the present invention, while FIG. 10 shows a sectional view of the can receiving apparatus of FIG. 9. Referring now to FIG. 9, the third embodiment of the present invention includes a door 1 that has the same general structure as the door shown in FIG. 5. Thus, the door 1 includes an outer case 2, and a plurality of projecting ribs 4*a*, 4*b*, and 4*c* on an inner case 3 that forms an interior wall. A support member 310 is installed between ribs 4*a* and 4*c*. The support member 310 and the inner case 3 form a can receiving space 300. A stop member 320 is installed below the support member 310. Additionally, the third embodiment includes speed reduction features that are explained in more detail subsequently.

The support member 310 is spaced apart from the interior wall of the inner case 3 so as to form the can receiving space 300. The support member 310 includes a longitudinal bar 311 for guiding and retaining cans in the can receiving space 300. The support member 310 further comprises upper and lower transverse bars 312 and 313 that are attached between the ribs 4*a* and 4*c* and that fix the longitudinal bar 311 in place.

The stop member 320 is a bar having ends that are fixed to the ribs 4*a* and 4*c*. The stop member 320 prevents cans from dropping through the can receiving space 300.

The ribs 4*a* and 4*c* include a plurality of fastening holes 5*a*, 5*b*, and 5*c*. The holes 5*a* and 5*b* retain the upper and lower transverse bars 312 and 313, while the holes 5*c* retain the stop bar 320.

The speed reduction features of the third embodiment include at least one buffering protrusion 330 on the interior wall formed by the inner case 3. FIG. 9 shows three buffering protrusions 330. A buffering protrusion 330 temporarily disturbs a can dropping through the can receiving space 300.

As shown in FIG. 10, a can 11 that is put into the inlet 301 drops down the can receiving space 300 until it reaches the stop member 320. To do so, the can 11 drops in a zigzag fashion as it strikes the buffering protrusions 330. This causes the dropping speed of the can 11 to be reduced.

In summary, according to the third embodiment of the present invention, the dropping speed of a can is reduced by buffering protrusions 330. Accordingly, the impacts of the can on the inner case 3 can be reduced, and thus damage and noise is reduced.

Fourth Embodiment

Figure 11:
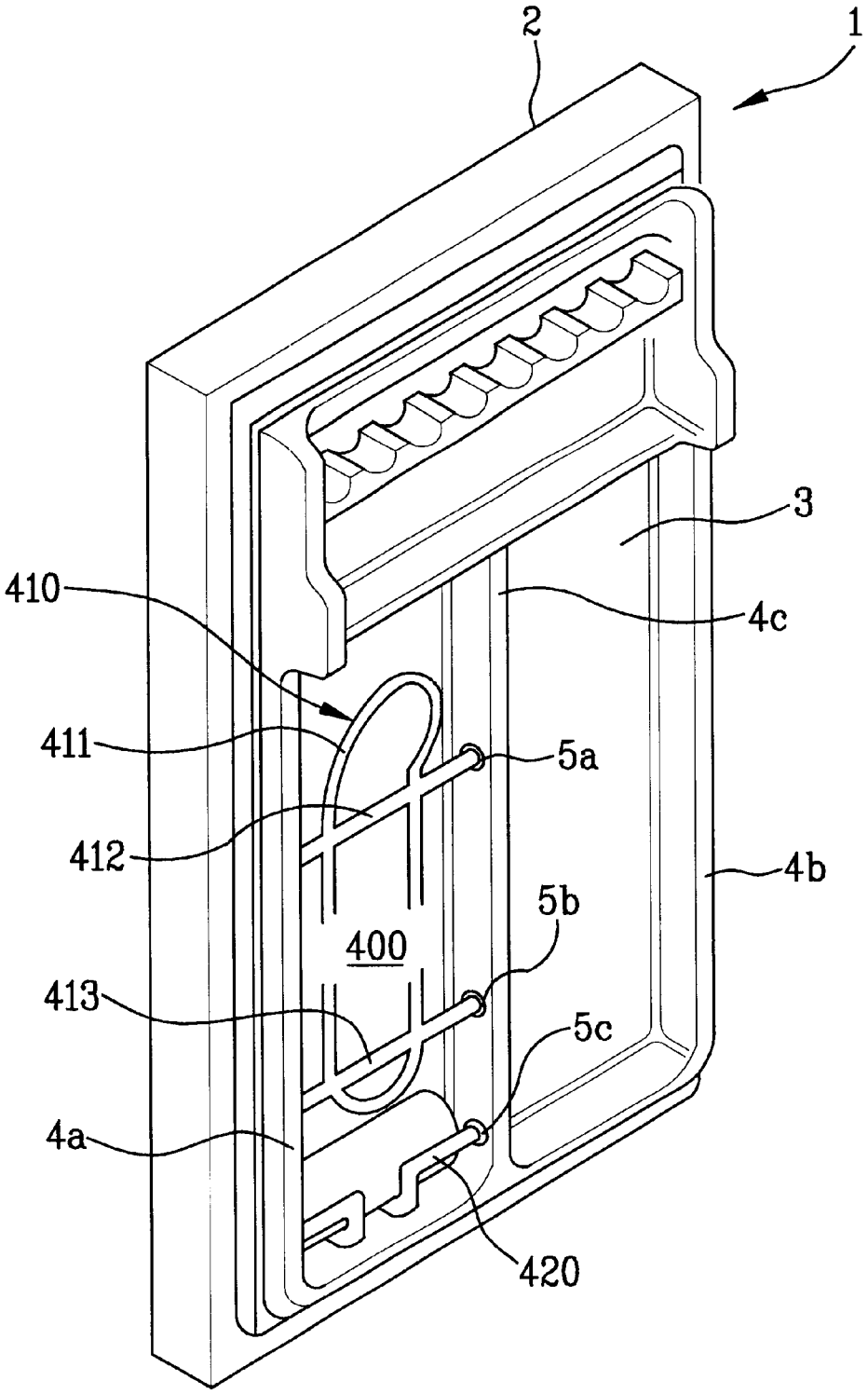
FIG. 11 is a perspective view illustrating a can receiving apparatus for a refrigerator according to a fourth embodiment of the present invention.
Figure 12:
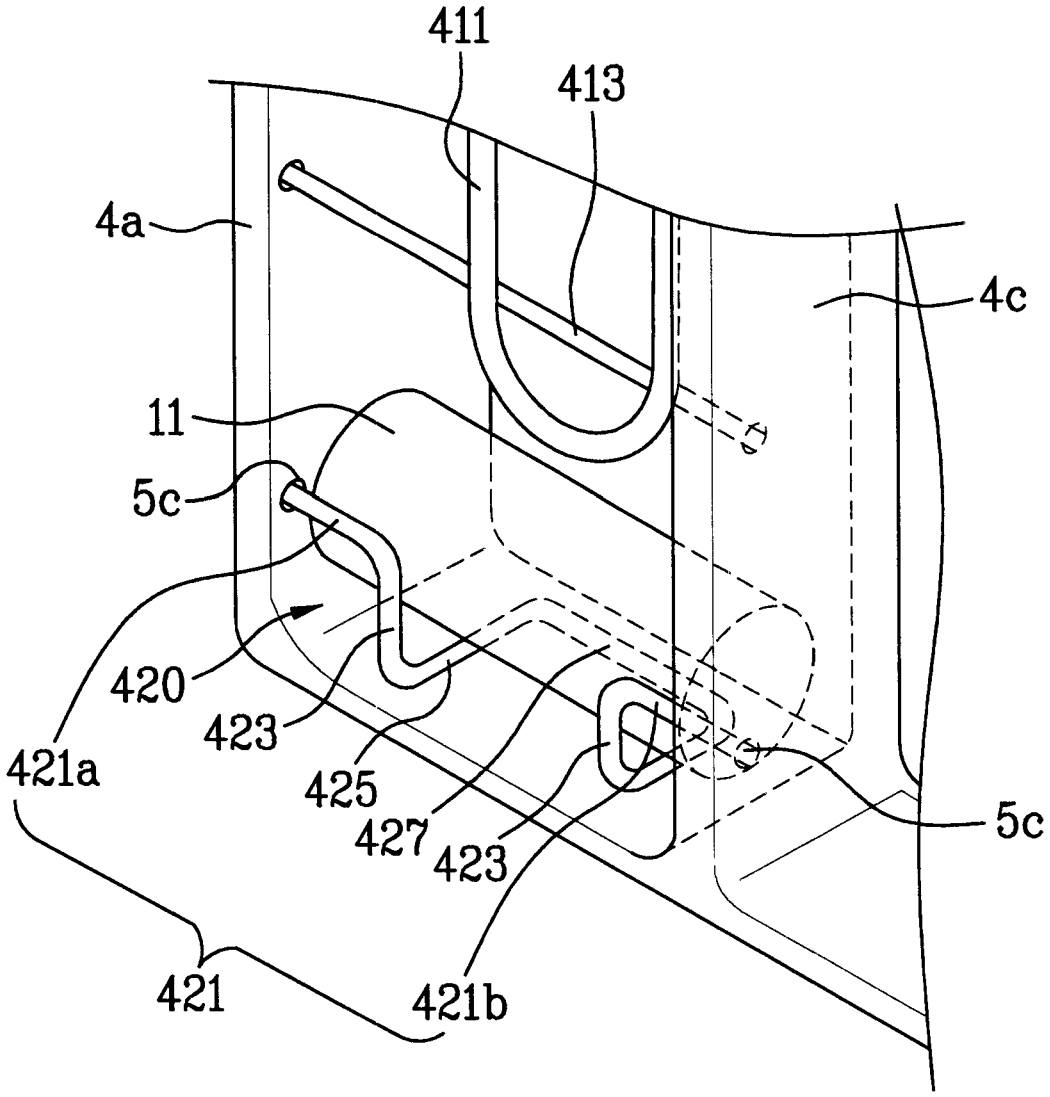
FIG. 12 is an enlarged perspective view illustrating a stop member in the can receiving apparatus of FIG. 11.

FIG. 11 is a perspective view illustrating a can receiving apparatus for a refrigerator according to a fourth embodiment of the present invention, while FIG. 12 is an enlarged perspective view illustrating a stop member in FIG. 11. Referring now to FIG. 11, the fourth embodiment of the present invention includes a door 1 that has the same general structure as the door shown in FIG. 5. Thus, the door 1 includes an outer case 2, and a plurality of projecting ribs 4*a*, 4*b*, and 4*c* on an inner case 3 that forms an interior wall. A support member 410 is installed between the ribs 4*a* and 4*c*, while a stop member 420 is installed between the ribs 4*a* and 4*c* below the support member 410.

The support member 410 comprises a longitudinal bar 411 that acts with the interior wall of the inner case 3 to form a can receiving space 400. The longitudinal bar 411 guides and retains cans placed into the can receiving space 400. The support member 410 further includes upper and lower transverse bars 412 and 413 that are attached to the ribs 4*a* and 4*c* and that fix the location of the longitudinal bar 411.

A plurality of fastening holes 5*a*, 5*b*, and 5*c* are formed on the ribs 4*a* and 4*c*. The upper and lower transverse bars 412 and 413 are retained by the fastening holes 5*a* and 5*b*, while the stop member 420 is retained by the fastening holes 5*c*.

The stop member is shown in more detail FIG. 12. As shown, the stop member 420 includes a fastening section 421, which prevents cans from falling out of the can receiving space 400, and a support section (described in more detail subsequently) that extends from the fastening section 421.

The fastening section 421 comprises a first fastening section 421*a* that is inserted in the third fastening hole 5*c* of rib 4*a* and that extends a predetermined length from rib 4*a*, and a second fastening section 421*b* that is inserted in the third fastening hole 5*c* of rib 4*c* and that extends a predetermined length from rib 4*c*. The distance between the first fastening section 421*a* and the second fastening section 421*b* should be less than the length of the can 11.

The support section comprises vertical connection sections 423 that extend downward from the first fastening section 421*a* and from the second fastening section 421*b*, inward connection sections 425 that extend from the vertical connection sections 423 toward the interior wall of the inner case 3, and a horizontal connection section 427 that extends between the connection sections 425. As shown, a can 11 can be held by the inward connection sections 425 and the horizontal connection section 427. Preferably, for easy withdrawal of a can 11, the inward connection section 425 and the horizontal connection section 427 are spaced apart from the bottom surface of the inner case 3.

While the stop member 420 is shown as being constructed from a single piece of material, such is not required. The various sections and features can be constructed of multiple members.

In the embodiment of the present invention, a can 11 dropping through the can receiving space 400 falls onto the support section of the stop member 420 and is stopped by the fastening section 421. As shown in FIG. 12, the front and the bottom of the can 11 are exposed. Accordingly, a user can withdraw the can 11 by lifting up and pulling out. During this procedure, it is not required for the user to place his/her hand between the stop member 420 and the inner case 3. Since the center of the stop member 420 is open, and thus the front side of the can is exposed, withdrawing a can is easy.

Fifth Embodiment

Figure 13:
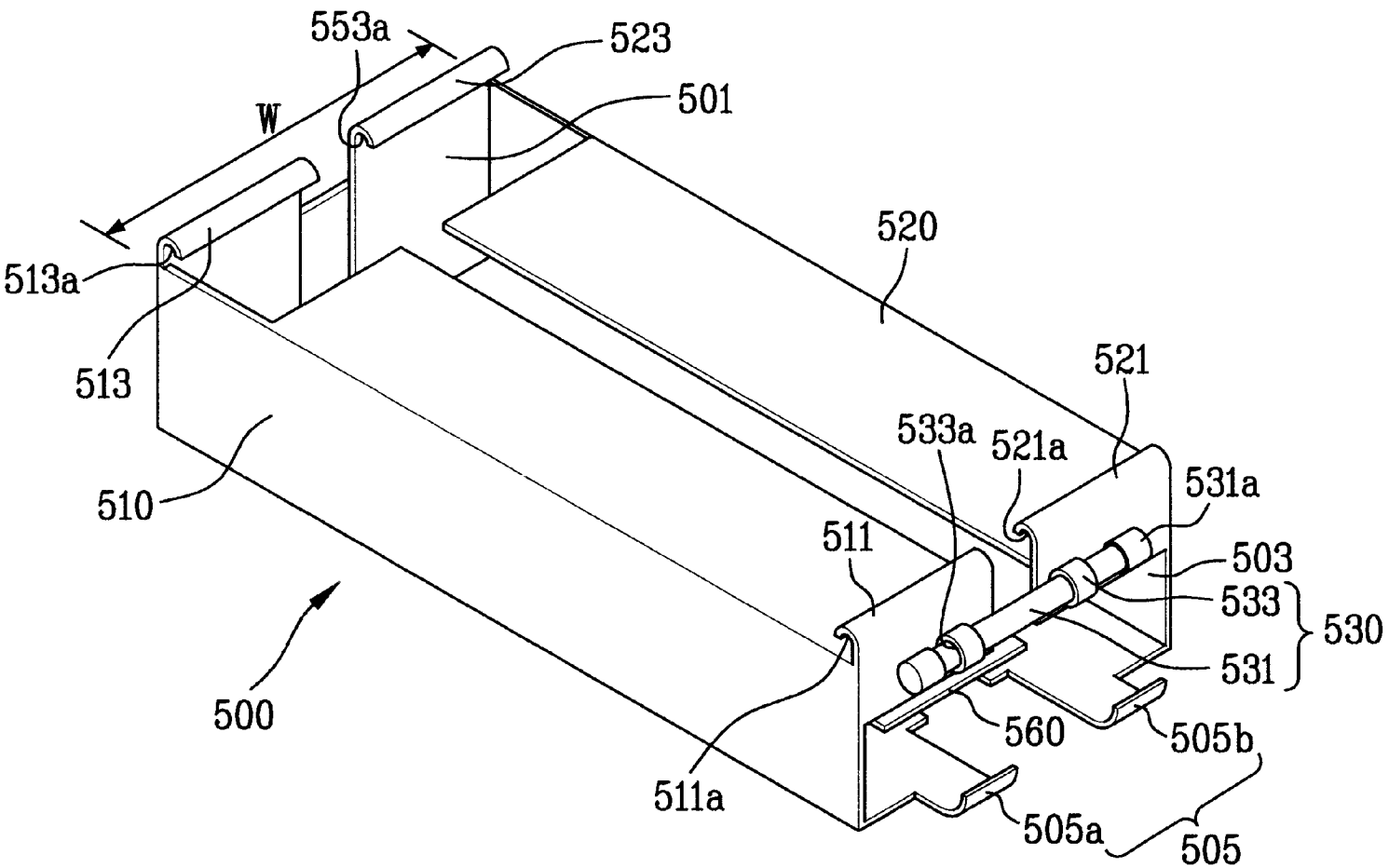
FIG. 13 is a perspective view illustrating a can receiving apparatus for a refrigerator according to a fifth embodiment of the present invention.
Figure 14:
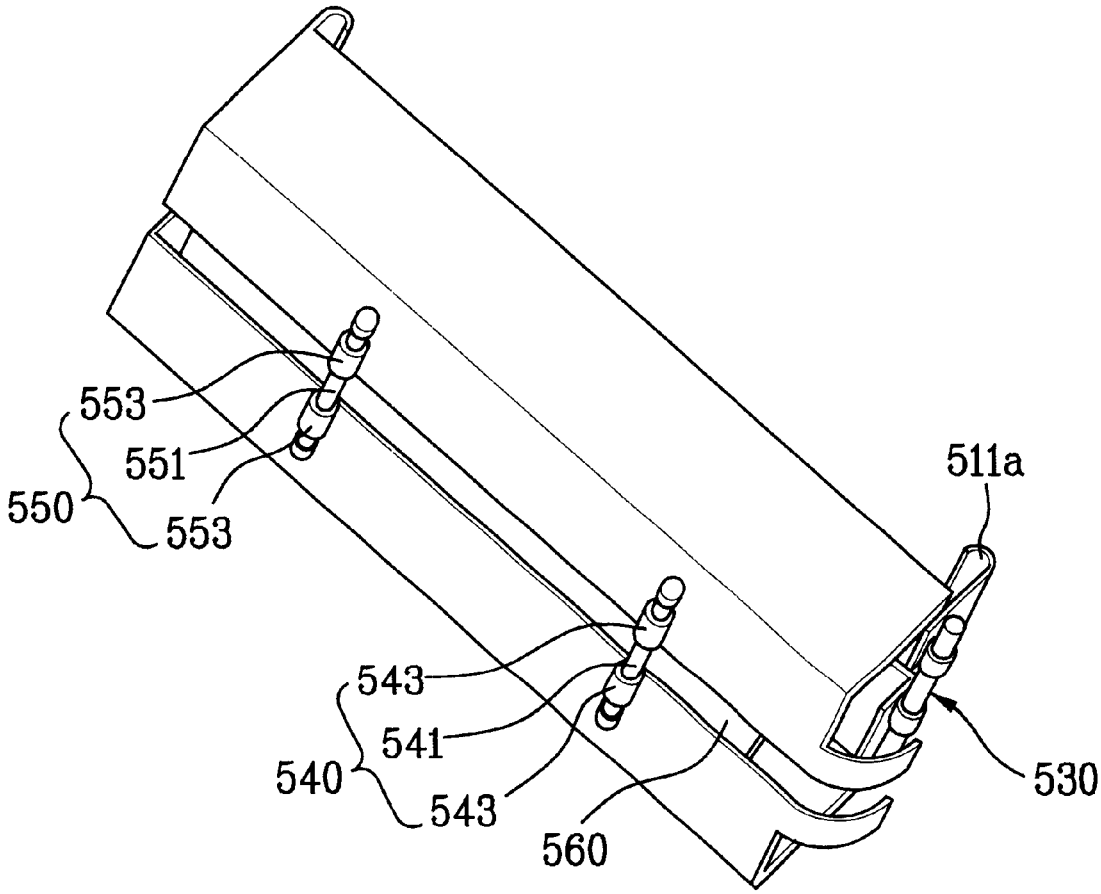
FIG. 14 is a perspective view illustrating bottom features of the can receiving apparatus of FIG. 13.

FIG. 13 illustrates a can receiving apparatus for a refrigerator according to a fifth embodiment of the present invention, while FIG. 14 is a perspective view illustrating the bottom of the can receiving apparatus of FIG. 13. Referring now to FIGS. 13 and 14, the fifth embodiment of the present invention includes a receptacle 500 that is comprised of two receiving space can be varied to accommodate cans of different lengths.

The body 510 and the body 520 have walls that, when the bodies main bodies, the bodies 510 and 520, that form a can receiving space. Fixing features are provided for fixing the receptacle 500 to a shelf inside a refrigerator, and fastening structures 530, 540, and 550 fasten the bodies 510 and 520 together such that the can 510 and 520 are fit together, define a rectangular box that forms a can receiving space. Additionally, the bodies 510 and 520 are configured such that, when they are fit together, an inlet 501 for receiving cans 11 is located at the rear of the receptacle 500 and an outlet 503 for removing cans 11 is located at the front of the receptacle 500. The outlet 503 has a support guide 505 for preventing free dropping of cans 11. The support guide 505 upwardly inclines a predetermined distance at the front of the receptacle 500. The support guide 505 includes a first support guide 505*a* that extends from the body 510 and a second support guide 505*b* that extends from the body 520.

The fixing features comprise hook members 511, 513, 521, and 523 having respective hook grooves 511*a*, 513*a*, 521*a*, and 523*a* that are used for attaching to a refrigerator shelf. The hook members 511~523 are formed at the front and rear of the receptacle 500. The hook members 511 and 513 extend from the body 510, while the hook members 521 and 523 extend from the body 520.

The fastening feature 530 comprises fastening sections 533 on the bodies 510 and 520, and a slide bar 531 that extends between the fastening sections 533. The fastening sections 533 include slide holes 533*a* that receive the slide bar 531. The fastening feature 530 can adjust the distance between the body 510 and the body 520. The slide bar 531 thus serves to fasten the body 510 and the body 520 together while enabling the separation between the bodies 510 and 520 to change. However, a flange 531*a* is formed on each end of the slide bar 531. The flanges 531*a* prevent the slide bar 531 from completely seceding from the slide holes 533*a*.

The inner bottom surface of the receptacle 500 is partially formed by a plate 560 on the bodies 510 and 520. If the distance between the bodies 510 and 520 becomes too large, the plate 560 prevents cans from dropping through the corresponding gap.

While the foregoing has described a single fastening feature 530, to improve the fastening between the bodies 510 and 520, a plurality of fastening features can be used. For example, referring now to FIG. 14, fastening features 540 and 550 are on the bottom of the receptacle 500. The fastening features 540 and 550 respectively include fastening sections 543 and 553 on the bodies 510 and 520. Additionally, the fastening features 540 and 550 respectively include slide bars 541 and 551 (both of which beneficially include flanged ends).

The operation of the receptacle 500 will now be explained. First, the receptacle 500 is attached to a refrigerator shelf with the outlet 503 in the front. Preferably the hook members 511 and 521 on the front of the receptacle 500 are somewhat longer than the hook members 513 and 523 on the rear of the receptacle 500. Thus, a can placed in the inlet 501 rolls forward to the outlet 503, where the support guide 505 stops the can. Thereafter, a user can withdraw the can.

If the length of the can is different than the width of the can receiving space, the bodies 510 and 520 can move along the slide bars 531, 541, and 551 to adjust the width of the can receiving space.

Alternative structures for adjusting the width W of the can receiving space include the use of a dovetail on body 510 and a dovetail groove on the body 520. Then, the width of the can receiving space can be adjusted by changing the fastening degree of the dovetail and the dovetail groove. Alternatively, a guide rail (for example, a "□"-shaped guide rail) may be formed on the body 510 while the body 520 has a guide section that is configured to fit into the guide rail. Then, the width of the can receiving space can be adjusted by varying the position of the guide section in the guide rail.

In summary, according to the fifth embodiment of the present invention, the width of a receptacle 500 is adjusted according to the size of the can, and thus cans of diverse sizes can be received in the receptacle.

As described above, the present invention has various advantageous.

First, fastening holes on an inner case are not required. Accordingly, insulation material leakage is prevented.

Second, the speed of a can dropping through a can receiving space can be reduced. Thus, the impact of cans on the inner case and any resulting noise can be reduced.

Third, the difficulty of removing a can from a can receiving space is reduced.

Fourth, since the size of the can receiving space is adjusted according to the size of the can, cans of diverse sizes can be accommodated in a can receiving space.

It will be apparent to those skilled in the art than various modifications and variations can be made in the present invention. Thus, it is intended that the present invention covers the modifications and variations of this invention provided they come within the scope of the appended claims and their equivalents.

What is claimed is:

1. A can receiving apparatus for a refrigerator, comprising:

an inner case having an interior wall formed between spaced apart ribs;

a fastening member extending between the ribs, wherein the fastening member includes two ends;

a support member connected to the fastening member and spaced apart from the interior wall so as to define a can receiving space;

a stop member below the support member for stopping cans from dropping through the can receiving space; and at least one fastening projection on a rib and having an open portion for receiving an end of the fastening member.

2. The apparatus according to claim 1, wherein the fastening projection is "U" shaped.

3. The apparatus according to claim 2, wherein the fastening projection is positioned such that the "U" shape is inclined toward the interior wall.

4. The apparatus according to claim 1, wherein the fastening projection is integrally formed with the inner case.

5. The apparatus according to claim 1, wherein the fastening projection is attached to a rib.

6. The apparatus according to claim 1, wherein the can receiving space includes a can inlet.

7. The apparatus according to claim 1, wherein the can receiving space includes a can outlet near the stop member.

8. The apparatus according to claim 1, wherein the can receiving space is dimensioned to receive a plurality of cans.

9. The refrigerator according to claim 1, wherein the speed reducer comprises:

an elastic member connected to the support member for supplying a bias force on the support member that tends to reduce the space between a portion of the support member and the interior wall.

10. The apparatus according to claim 9, wherein the fastening member tends to rotate under the bias force.

11. The apparatus according to claim 9, wherein the elastic member is a spring installed between the interior wall and the support member pulls the support member toward the interior wall.

12. The apparatus according to claim 9, wherein the speed reducer includes a fixing bar between the ribs.

13. The apparatus according to claim 12, wherein the elastic member is a spring that biases the support member toward the interior wall.

14. The apparatus according to claim 9, wherein the speed reducer includes at least one buffering protrusion on the interior wall that disturbs the dropping of the can.

15. The apparatus according to claim 14, wherein the buffering protrusion is integrally formed with the interior wall.

16. The apparatus according to claim 14, wherein the buffering protrusion is attached to the interior wall.

17. The apparatus according to claim 16, wherein the buffering protrusion is comprised of an elastic material.

18. The apparatus according to claim 14, wherein the speed reducer causes cans in the can receiving space to be stored in a zigzag pattern.

19. A can receiving apparatus for a refrigerator, comprising:

a case having ribs that are spaced apart by an interior wall;

a fastening member extending between the ribs and having two ends;

a support member connected to the fastening member and spaced apart from the interior wall so as to form a can receiving space;

a stop member below the support member for stopping cans from dropping through the can receiving space; and a speed reducer for reducing the speed of a can dropped through the can receiving space.

20. The apparatus according to claim 9, wherein the can receiving space includes an inlet.

21. The apparatus according to claim 9, wherein the can receiving space includes an outlet near the stop member.

22. The apparatus according to claim 9, wherein the can receiving space is dimensioned to receive a plurality of cans.

23. A can receiving apparatus for a refrigerator, comprising:

a case having ribs that are spaced apart by an interior wall;

a fastening member extending between the ribs;

a support member connected to the fastening member and spaced apart from the interior wall so as to form a can receiving space; and a stop member below the support member and between the ribs for stopping cans from dropping through the can receiving space, the stop member having a relieved center portion.

24. The apparatus according to claim 23, wherein the stop member comprises:

a pair of fastening sections that extend predetermined distances from the ribs toward the center of the can receiving space;

a pair of support sections that extend predetermined distances from the fastening sections toward the interior wall; and a connection section that connects the support sections together.

25. The apparatus according to claim 23, wherein the stop member is an integral member.

26. The apparatus according to claim 23, wherein the can receiving space includes an inlet at the top of the support member.

27. The apparatus according to claim 26, wherein the can receiving space is dimensioned to receive a plurality of cans.

28. An apparatus having a can receiving apparatus, comprising:

a receptacle comprised of first and second main bodies that form a can receiving space, wherein the first and second main bodies form an inlet for receiving cans and an outlet for enabling can removal;

a fixing structure connected to the first and second main bodies for attaching the receptacle to a shelf; and a fastener for fastening the first and the second main bodies together such that the width of the can receiving space can be adjusted by changing the distance between the first and second main bodies.

29. The apparatus according to claim 28, wherein the fastener comprises:

fastening sections, each having a slide hole on the first main body and on the second main body; and slide bars, each inserted in a slide hole on the first main body and in a slide hole on the second main body;

wherein the slide bars can slide in the slide holes such that the distance between the first main body and the second main body can be adjusted.

30. The apparatus according to claim 29, wherein the slide bars have flanges that prevent the slide bar from being removed from the slide holes.

31. The apparatus according to claim 29, wherein fastening sections are below the first and second main bodies.

32. The apparatus according to claim 30, wherein a fastening section is in front of the first and second main bodies.

33. The apparatus according to claim 28, wherein the fixing structure includes grooved hooks.

34. The apparatus according to claim 28, further including a plate between the first main body and the second main body and that forms a bottom surface.

35. The apparatus according to claim 28, wherein the outlet includes a support guide that extends with an upward inclination for preventing free dropping of cans.

36. The apparatus according to claim 28, wherein the first main body and the second main body include top covers.

37. The apparatus according to claim 28, wherein the can receiving space is dimensioned to receive a plurality of cans.

38. A refrigerator having a can receiving apparatus, comprising:

a case having ribs that are spaced apart by an interior wall;

a fastening member extending between the ribs;

a support member connected to the fastening member and spaced apart from the interior wall so as to form a can receiving space;

a stop member below the support member for stopping cans from dropping through the can receiving space; and a fastening projection on a rib, the fastening projection having an open portion for receiving an end of the fastening member such that the fastening projection is retained in position.

39. A refrigerator having a can receiving apparatus, comprising:

a case having sidewalls formed by an inner wall and a rib that is spaced apart from the inner wall, the case further including an interior wall having an inner surface;

at least one fastening member extending between the sidewalls;

a support member connected to the fastening member and spaced apart from the inner surface so as to form a can receiving space;

a stop member below the support member for stopping cans from dropping through the can receiving space; and a speed reducer for reducing the speed of a can dropped into the can receiving space.

40. A refrigerator having a can receiving apparatus, comprising:

a case having sidewalls formed by an inner wall and a rib that is spaced apart from the inner wall, the case further including an interior wall having an inner surface;

at least one fastening member extending between the sidewalls;

a support member connected to the fastening member and spaced apart from the inner surface so as to form a can receiving space; and a stop member below the support member and between the sidewalls for stopping cans from dropping through the can receiving space, the stop member having a relieved center portion that enables easy removal of a can in the can receiving space.

41. A refrigerator having a can receiving apparatus, comprising:

a receptacle comprised of first and second main bodies that form a can receiving space, wherein the first and second main bodies further form an inlet for receiving cans and an outlet for enabling can removal;

a fixing structure connected to the receptacle and attaching the receptacle to a refrigerator shelf; and a fastener for fastening the first and the second main bodies together such that the width of the can receiving space can be adjusted by changing the distance between the first and second main bodies.

* * * * *